US007191764B2

(12) United States Patent
Hattori

(10) Patent No.: US 7,191,764 B2
(45) Date of Patent: Mar. 20, 2007

(54) CONTROL UNIT FOR AN INTERNAL COMBUSTION ENGINE

(75) Inventor: Shogo Hattori, Kawachi-gun (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 10/553,687

(22) PCT Filed: Apr. 19, 2004

(86) PCT No.: PCT/JP2004/005566

§ 371 (c)(1),
(2), (4) Date: Oct. 17, 2005

(87) PCT Pub. No.: WO2004/094803

PCT Pub. Date: Nov. 4, 2004

(65) Prior Publication Data

US 2006/0288987 A1 Dec. 28, 2006

(51) Int. Cl.
*F02D 41/18* (2006.01)
*F02D 45/00* (2006.01)

(52) U.S. Cl. ..... 123/478; 701/105; 123/494

(58) Field of Classification Search ..... 123/361, 123/399, 478, 480, 494; 701/103–105
See application file for complete search history.

(56) References Cited

U.S. PATENT DOCUMENTS 4,548,181 A * 10/1985 Ishikawa et al. ..... 123/492
4,819,603 A * 4/1989 Morita et al. ..... 123/406.21
2006/0207572 A1* 9/2006 Yatabe ..... 123/494

FOREIGN PATENT DOCUMENTS

| | | | |
|---|---|---|---|
| EP | 0400 642 | A1 | 12/1990 |
| JP | 3-950 | | 1/1991 |
| JP | 4-15388 | | 3/1992 |
| JP | 7-167697 | | 7/1995 |
| JP | 8-218934 | A * | 8/1996 |
| JP | 2001-234798 | | 8/2001 |

OTHER PUBLICATIONS

Microfilm of the specification and drawings annexed to the request of Japanese Utility Model Application No. 84576/1988 (Laid-open No. 22842/1989), Feb. 7, 1989.

* cited by examiner

*Primary Examiner*—Hieu T. Vo
(74) *Attorney, Agent, or Firm*—Squire Sanders & Dempsey L.L.P.

(57) ABSTRACT

A control unit calculates a quantity of air that is taken into an engine from an output current from an air flow meter that is located downstream from a throttle valve. The control unit then determines the quantity of fuel to be injected for this quantity of air. The control unit determines a rise in the air intake as being when the quantity of air is on an increasing trend and has exceeded a predetermined threshold value. In contrast, the control unit determines a fall in the air intake as being when the quantity of air is on a decreasing trend and has exceeded a predetermined threshold value. An injection of fuel starts from a rise in the air intake and is ended at an earlier timing than the end of the air intake.

4 Claims, 3 Drawing Sheets

CONTROL UNIT FOR AN INTERNAL COMBUSTION ENGINE

TECHNICAL FIELD

The present invention relates to a control unit that controls an injection quantity of fuel that is supplied to an internal combustion engine. Priority is claimed on Japanese Patent Application No. 2003-116813, filed Apr. 22, 2003, the content of which is incorporated herein by reference.

BACK GROUND ART OF THE INVENTION

Conventionally, a method of controlling combustion in an internal combustion engine of a vehicle or the like is known (see, for example, Japanese Examined Patent Application, Second Publication No. H04-15388) in which the quantity of fuel that is injected is controlled so as to match the quantity of air that is taken in from the outside, and a mixture of air and fuel is ignited and combusted in accordance with the angle of rotation of the crankshaft.

Here, the technology that controls this fuel injection is disclosed in the aforementioned document. Specifically, a structure is employed to control the fuel injection into a multi cylinder engine in which a flow rate sensor is provided on an air intake passage between a throttle valve and an electromagnetic injection valve. A control circuit calculates a basic fuel injection quantity at predetermined timings from an average value of the flow rate of the intake air that is detected by the flow rate sensor. Fuel injection is then performed based on this basic injection quantity. The cylinders performing the air intake switch in sequence during one engine cycle. Variations in the intake air flow rate that are generated at this time are taken as deviations from the average value of the intake air flow rate, and deviation signals corresponding to these deviations are input directly into a voltage circuit of the electromagnetic injection valve. The fuel injection quantity is increased when there is a large deviation signal, and is decreased when there is a small deviation. For this calculation of the basic fuel injection quantity, compensation is performed using an air intake temperature sensor that detects the temperature of the air that is taken in and a cooling water temperature sensor that detects the temperature of the engine cooling water.

In order to improve combustion efficiency and response, it is desirable that the quantity of air that is actually taken into an internal combustion engine is measured at each intake, and that the optimal fuel quantity be determined for each air intake quantity. However, each time the output of the voltage circuit is varied in accordance with the amount of the deviation in the current, as is described above, there is no problem when the deviation is small, however, when the deviation in the flow rate is large, as is the case in a single cylinder engine or the like, it is not possible to inject the correct quantity of fuel.

Furthermore, when an injection quantity is calculated while a correction is being made by the air intake temperature sensor or the like, the calculation processing becomes complex, and the problem arises that a considerable burden is placed on the control unit. Here, when a number of sensors are used to control an internal combustion engine, there is a tendency for there to be a large increase in the number of steps when setting the sensors and an increase in the restrictions on layout. Therefore, there is a demand for control of an internal combustion engine to be performed using a small number of sensors.

Accordingly, the present invention was conceived in order to solve the above described problems, and it is an object thereof to provide a control unit for an internal combustion engine that has a simple structure and enables a required quantity of fuel to be injected and combusted at an appropriate timing.

DISCLOSURE OF INVENTION

The present invention provides a control unit for an internal combustion engine that: detects, using a sensor that is located on a downstream side of a throttle valve on an air intake passage of an internal combustion engine, a quantity of air that is taken into the internal combustion engine; and outputs a signal to an injector of the internal combustion engine such that fuel is injected in accordance with this quantity of air, wherein a timing of a rise of an air intake in which the quantity of air increases as an intake stroke of the internal combustion engine progresses and a timing of a fall of an air intake in which the quantity of air decreases as the intake strokes progresses are determined from the quantity of air and the increases and decrease thereof, and a fuel injection quantity is calculated by multiplying a predetermined constant by a quantity of air that is taken in during a period from the timing of the air intake rise until the timing of the air intake fall.

According to this control unit for an internal combustion engine, the fact that there is a sizeable increase in the quantity of air on the downstream side of the throttle valve of the air intake passage when an internal combustion engine commences an air intake is observed, and the start time of an intake stroke of the internal combustion engine is specified by tracking temporal changes in the quantity of air. The quantity of air from this point in time until the quantity of air decreases in conjunction with the ending of the air intake is integrated, and a suitable fuel injection quantity for the integrated quantity of air is calculated. Fuel is then injected from an injector in accordance with this calculated quantity.

In the control unit for an internal combustion engine of the present invention, it is preferable that the timings of rises in the air intake be when the quantity of air that increases with elapsed time reaches a predetermined value that is in excess of a quantity that corresponds to a pulse flow or minimal flow of air inside the air intake passage.

According to this control unit for an internal combustion engine, when a pulse flow or minimal flow of air is generated inside an air intake passage by the opening and closing of an air intake valve of the internal combustion engine, a distinction is made from the amount of the quantity of air between a movement of air that is caused by a pulse flow or minimal flow and a movement of air that is caused by an intake stroke of the internal combustion engine. Note that pulse flows and minimal flows are movements of air that are generated by the open or closed states of air intake valves and throttle valve, and a detailed description thereof is given in the embodiment.

In the control unit for an internal combustion engine of the present invention, it is preferable that a cycle of the rises in the air intake be measured.

According to this control unit for an internal combustion engine, the cycle of air intake rises that are generated at each intake stroke of an internal combustion engine are counted, and the number of revolutions of the internal combustion engine are calculated from the result. Moreover, because the angle to which the rotation shaft of the internal combustion engine rotates up until the next rise in the air intake is fixed for each internal combustion engine, it is possible to calculate the rotation angle of the rotation shaft in the time that has elapsed from the rise in the air intake. In addition, it is possible to decide the timings of fuel injections and the timings of ignitions and the like by associating them with rises in the air intake.

BRIEF DESCRIPTION OF THE DRAWINGS

FIG. 2 is a view showing an example of fuel injection control and control of an ignition circuit that are performed based on changes in a quantity of air, which changes in conjunction with an operation of an engine, and changes in a quantity of air that is taken in.

BEST MODE FOR CARRING OUT THE INVENTION

Figure 1:
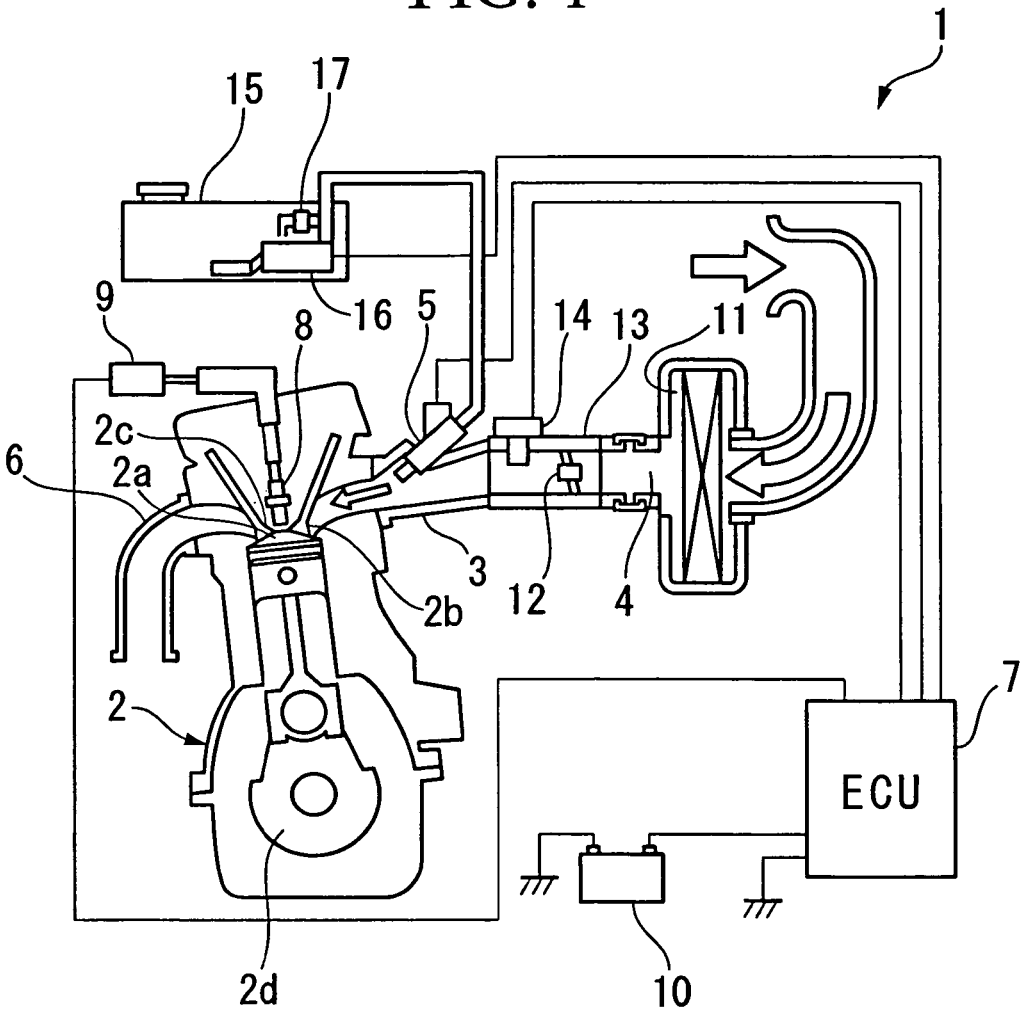
FIG. 1 is a schematic view showing an engine control system that includes a control unit of an embodiment of the present invention.

An embodiment of the present invention will now be described in detail with reference made to the drawings. FIG. 1 is a schematic view showing an engine control system that is provided with the control unit for an internal combustion engine of the present embodiment.

An engine control system 1 of the present embodiment that is shown in FIG. 1 takes in air from an air intake passage 4 that is joined to an air intake manifold 3 of an engine 2, which is an internal combustion engine. This air is then mixed with fuel that is discharged from an injector 5 located in the air intake manifold 3. The air-fuel mixture is then combusted in a combustion chamber 2*a* of the engine 2. When the combustion gas is discharged after the combustion from an exhaust manifold 6, a control unit 7 controls injection quantities and injection timings of fuel that is injected in accordance with the quantity of air that is taken in (i.e., the air intake quantity) by the engine 2, and also controls ignition timings of the air and fuel vapor mixture.

The air intake passage 4 has an air cleaner 11 and a throttle body 13 that is provided with a throttle valve 12 (i.e., a diaphragm valve) that performs air quantity adjustment on a downstream side of the air cleaner 11. The quantity of the air that is taken into the engine 2 through the air intake passage 4 is detected as a mass flow rate by an air flow meter 14 (i.e., a sensor) that is located on a downstream side from the throttle valve 12. As a result of the air flow meter 14 being located on the downstream side of the throttle valve 12, it is possible to subtract the quantity of air that is supplied between the throttle valve 12 and an air intake valve 2*b* from the air that is supplied through the throttle valve 12, and thereby accurately detect the quantity of air that is actually taken into the combustion chamber 2*a* of the engine 2. Note that, when the air flow meter 14 is located on the throttle body 13, the number of setting steps can be reduced.

A preferred example of the air flow meter 14 of this embodiment is a sensor formed by depositing a thin platinum film on a silicon substrate and then energizing it such that the temperature of the thin platinum film is kept constant. If there is an increase in the mass of the air circulating around the thin platinum film, the quantity of heat that is lost via the air from the thin platinum film increases and the temperature of the thin platinum film drops proportionally. At this time, the air flow meter 14 causes the current being supplied to the thin platinum film to be increased so as to keep the temperature constant. In contrast, because there is a decrease in heat loss and the temperature of the thin platinum film rises if there is a decrease in the quantity of circulating air, the air flow meter 14 causes the current being supplied to the thin platinum film to be decreased. Because the current value increases or decreases proportionally to the increase or decrease in the mass of the air circulating around the thin platinum film, the air quantity can be measured by monitoring this current value. Note that, because it is possible to reduce the heat mass by using the above described type of air flow meter 14 compared to when wires made from platinum are used, a high response and a high degree of measurement accuracy are achieved.

The injector 5 injects fuel into the air flowing through the air intake manifold 3 using an opening and closing action of an electromagnetic injection valve. Fuel that has been pumped out from inside a fuel tank 15 by a fuel pump 16 and then undergone pressure adjustment by a regulator 17 is supplied to the injector 5.

The supply of vapor mixture to the combustion chamber 2*a* and the discharge thereof after combustion are performed by the air intake valve 2*b* and an exhaust valve 2*c* that are driven by a valve timing mechanism (not shown).

The vapor mixture is ignited by a spark plug 8. The spark plug 8 discharges electricity using high energy that is accumulated in an ignition circuit 9.

The control unit 7 that governs control in the engine control system 1 is also known as an electronic control unit (ECU) and is provided with a central processing unit (CPU) and read only memory (ROM). The control unit 7 operates by receiving power supplied from a battery 10. This control unit 7 performs predetermined processing using as input data the current that is output from the air flow meter 14. The control unit 7 determines quantities of fuel that are supplied from the fuel pump 15 to the injector 5, injection quantities from the injector 5 as well as the injection timings thereof, the start timings of electrical discharges to the ignition circuit 9, and the ignition timings, and also outputs command signals to the respective sections.

Figure 2:
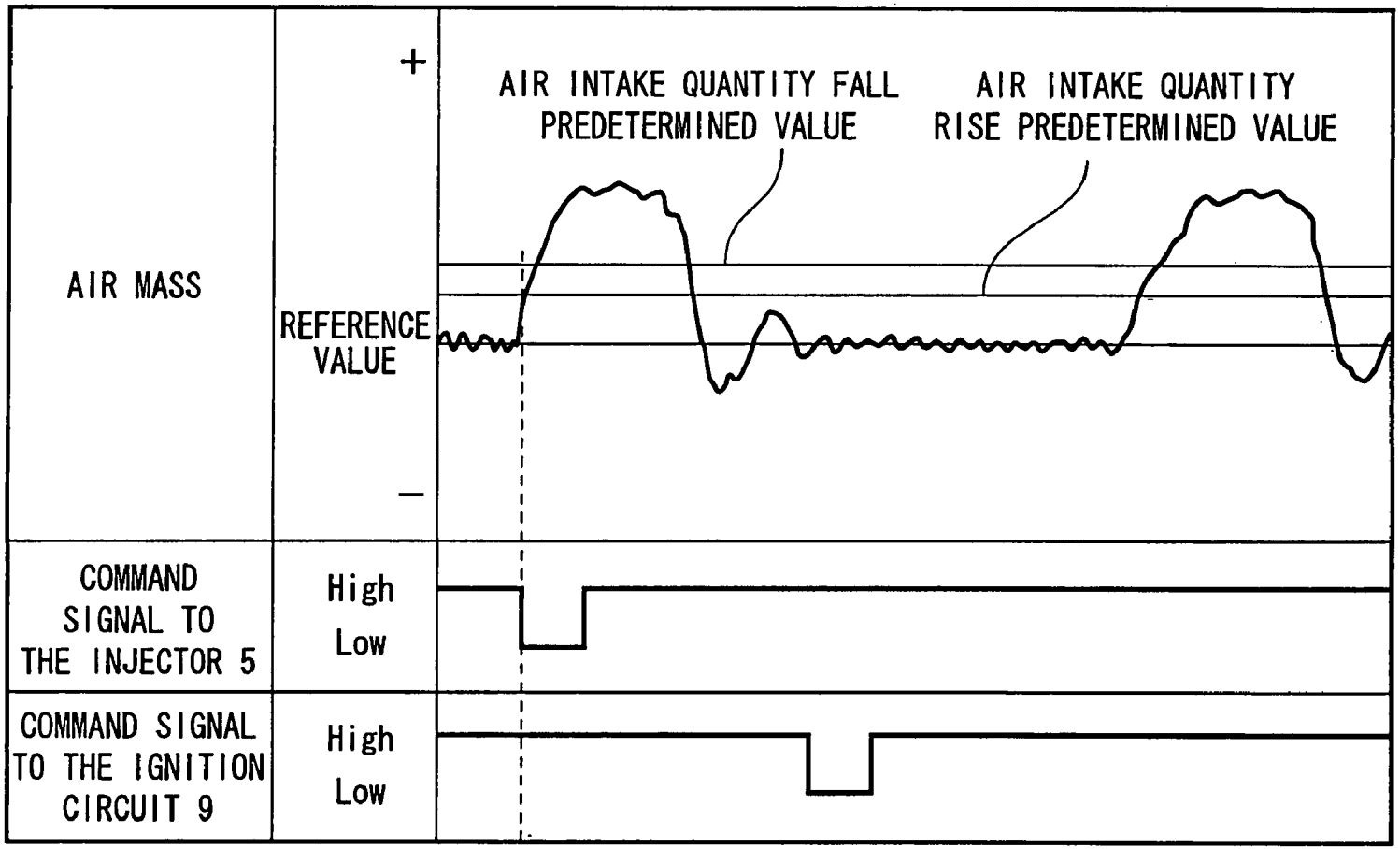

Here, a description is given of the processing and the data that is processed by the control unit 7 using FIGS. 1 and 2. Note that FIG. 2 is a graph showing changes in air quantity, which changes in conjunction with the operation of the engine, and command signals to the injector that are output in accordance with the quantity of air that is taken in, and also command signals to the ignition circuit. The horizontal axis in this graph shows time, and the air mass is a value obtained by a conversion from the output current from the air flow meter 14. When the command signal to the injector 5 is High, the electromagnetic injection valve of the injector 5 is closed, while when the command signal is Low, the electromagnetic injection valve is opened. When the command signal to the ignition circuit 9 switches from High to Low, an electric discharge is begun, when it switches from Low to High, the electric discharge is ended and ignition is performed.

The quantity of air that varies as time elapses is a value obtained by multiplying a predetermined constant by the output current from the air flow meter 14. The air quantity that is obtained is treated as a forward flow when it is greater than a predetermined threshold value (i.e., a reference value), and as a backward flow when it is less than this threshold value. Note that the term "forward flow" refers to when the air is flowing in the direction in which it is taken into the engine 2. The term "backward flow" refers to when the air is flowing in a reverse direction, namely, in the direction of the throttle valve 12. A backward flow is generated when the air intake valve 2*b* of the engine 2 is closed and the blocked air is made to flow in a reverse direction. A pulse current is the state that occurs when this forward flow and backward flow alternate.

In some cases, the air intake valve 2*b* of the engine 2 is opened when the throttle valve 12 is in a slightly open state. However, in such cases, negative pressure is generated inside the air intake passage 4. Because this negative pressure remains even when the air intake valve 2*b* is closed, a slight flow of air entering along the throttle valve 12 may be generated. The flow of air that is generated under such conditions is taken as a minimal current.

In addition, areas where the air quantity increases and exceeds the range of this pulse current and minimal current are areas where air is taken into the engine 2, and correspond to the intake stroke of the engine 2. The sum total of the quantity of air in excess of the reference value inside this area provides the total air intake quantity of the engine 2 in that intake stroke. The start of an air intake (i.e., an air intake rise point) is taken as the starting point for this type of rise in the air quantity when the quantity of air is a larger value than the reference value and exceeds an air intake quantity rise predetermined value that has been determined in advance. Namely, when the quantity of air is on an increasing trend and has reached the air intake quantity rise predetermined value, the taking in of air into the engine 2 is regarded as having started. The determination of the end of an air intake (i.e., an air intake fall point) is taken as the time when the quantity of air that had increased to exceed the air intake quantity rise predetermined value is subsequently inverted so as to decrease and drops below an air intake fall predetermined value that is set at a value that is greater than the air intake quantity rise predetermined value. Namely, when the quantity of air is on a decreasing trend and has reached the air intake quantity fall predetermined value, the taking in of air into the engine 2 is regarded as having ended.

The rise in the air intake appears cyclically in conjunction with the rotation of the engine 2, and a cycle generated by the air intake rise corresponds to one stroke of the relevant cylinder. Accordingly, by examining the elapsed time from the point when the air intake rise occurred, it is possible to ascertain the rotation angle (for example, the rotation angle that corresponds to the timing when the vapor mixture is ignited) at that time of the crankshaft 2*d* (see FIG. 1). Moreover, by counting the number of air intake rises that are generated within a predetermined time, it is possible to ascertain the number of revolutions and the revolution speed of the engine 2.

The command signals to the injector 5 change from High to Low for a predetermined length of time from the point when a rise in the air intake is confirmed. During this time, the injector 5 injects fuel into the air intake manifold 3. This predetermined time is the length of time that is needed to inject the required quantity of fuel, which is determined from the air intake quantity, from the injector 5. The required quantity of fuel is obtained by dividing by the air-fuel ratio the sum total of the air intake quantity from the air intake rise point until the air intake fall point.

In the present embodiment, because the injector 5 is attached to the air intake manifold 3, a fuel injection is ended during a period extending from when an air intake is confirmed and the fuel injection is started until the air intake ends, namely, during a period until the air intake valve 2*b* of the engine 2 is closed. This is in order for the required quantity of fuel to be reliably supplied, and for the fuel to be injected into the air flowing into the engine 2 and be properly mixed with this air. Note that, in the case of what is known as a direct injection type of engine, once a fall in the air intake has been confirmed, a command signal is output to the injector such that a quantity of fuel that is obtained by multiplying the air-fuel ratio by the sum total of the air intake quantity is injected.

A command signal to the ignition circuit 9 changes from High to Low after a predetermined wait time has elapsed from the time when a rise in the air intake was confirmed. It then changes from Low to High after a predetermined ignition timing time has elapsed from the time when the rise in the air intake was confirmed. This ignition timing time is a period of time from an air intake rise point to the timing when the vapor mixture is ignited. The wait time is a time obtained by subtracting the time required to charge the ignition circuit with the necessary energy from the ignition timing time. Because the necessary energy changes depending on the air intake quantity, the wait time also changes depending on the air intake quantity. The reason why the ignition timing is measured from the air intake rise point is because, as is described above, the rotation angle of the crankshaft 2*d* can be expressed as an elapsed time from the air intake rise point.

The control unit 7 that performs the above described processing has an air quantity calculating device that calculates a quantity of air by multiplying a predetermined constant by an output current from the air flow meter 14, an air intake determining device that determines air flow directions as well as air intake rise points and fall points that are generated by an intake stroke, a total air intake quantity calculating device that calculates a sum total of the air intake quantity of an intake stroke, an injection quantity calculating device that calculates a fuel injection quantity in accordance with a total air intake quantity and also controls the injector 5 and the like, and an ignition control device that calculates and controls charging times of the ignition circuit 9 in accordance with the air intake quantity and fuel quantity.

Next, a description will be given of the fuel injection control conducted by the control unit 7 with reference made to FIGS. 1 and 2 and to the flowchart shown in FIG. 3. This control is performed as interrupt processing at regular fixed cycles after the engine 2 has started.

Firstly, in step S1, an air quantity is calculated from an output current from the air flow meter 14. Next, in step S2 and step S3, an air intake rise point, which shows that an intake of air into the combustion chamber 2*a* has started in conjunction with an intake stroke of the engine 2, is determined. Namely, when the quantity of air calculated in step S1 is equal to or more than an air intake quantity rise predetermined value (i.e., when the result of the determination in step S2 is YES), then it is regarded not as a pulse flow or minimal flow, but as the quantity of air that is taken into the engine 2, namely, the air intake quantity. Furthermore, when it is determined that the air intake quantity is on an increasing trend (i.e., when the result of the determination in step S3 is YES), then it is determined that an intake of air into the combustion chamber 2*a* has started. Here, the predetermined value is a threshold value (i.e., the reference value shown in FIG. 2) for distinguishing between a pulse flow or minimal flow and an intake of air, and is registered in advance in the control unit 7. Note that, in step S2, when the air intake quantity is less than the air intake quantity rise predetermined value, the processing here is ended.

Once a rise in the air intake has been confirmed, in step S4, total air intake calculation processing is performed. As a result of this processing, the sum total of the air intake quantity from the air intake rise point is calculated. Once the air intake quantity sum total has been calculated, when fuel injection is permitted (i.e., when the result of the determination in step S5 is YES), fuel injection processing is performed in step S6. However, when fuel injection is not permitted (i.e., when the result of the determination in step S5 is NO), the processing here is ended. An example of such a case is when fuel injection was being performed on the most recent intake stroke.

In the fuel injection processing in step S6, a fuel injection quantity is determined such that the ratio of fuel relative to the sum total of the air intake quantity reaches a predetermined value, and a command signal is output to the fuel pump 16 and injector 17 shown in FIG. 1 such that this injection quantity is injected. Because fuel is injected into the air that is actually taken into the combustion chamber 2*a*, the fuel and air are reliably mixed together. A command signal output to the injector 5 corresponds to the signal level in FIG. 2 being at Low.

When ignition is then permitted (i.e., when the result of the determination in step S7 is YES), the routine moves to step S8 where wait time processing is performed. A spark is then supplied to the vapor mixture and the processing here is ended. The wait time processing determines the length of the wait time shown in FIG. 2 and, as is described above, when the air intake quantity and fuel quantity are both larger, the energy needed for the ignition also increases. Therefore, a modification is made such that the wait time is shortened by the appropriate amount and charging time is lengthened. Note that, when ignition is not permitted (i.e., when the result of the determination in step S7 is NO), then the processing ends with no further action being taken. An example of such a case is when there is a considerable discrepancy between the previous ignition timing time that was calculated from the previous air intake cycle (i.e., the number of revolutions of the engine 2) and the current ignition timing time that is determined from the current air intake rise predetermined value.

This processing is repeated in a predetermined regular cycle and fuel injection control, such as the calculation of the sum total of the air intake quantity (i.e., step S4) as well as the injection of a quantity of fuel corresponding to this air intake quantity (i.e., step S6), is performed in real time.

Here, the quantity of air that has risen as the air intake has progressed eventually reverses and begins to decrease and become less than the air intake quantity rise predetermined value (i.e., the result of the determination is step S2 is NO), and the air intake is ended. In this process, cases may occur in which the air intake quantity is equal to or more than the air intake quantity rise predetermined value (i.e., the result of the determination in step S2 is YES) but is not on an increasing trend (i.e., the result of the determination in step S3 is NO). In such cases, it is confirmed in step S9 that the air intake quantity has decreased to less than the air intake quantity fall predetermined value. When it is less than the air intake quantity fall predetermined value (i.e., when the result of the determination in step S9 is YES), then the air intake is regarded as having ended and, in step S10, the fuel injection is ended. The processing sequence is then ended. The ending of the fuel injection corresponds to the signal level of the command signal to the injector 5 in FIG. 2 changing to High.

In step S9, when the air intake quantity is equal to or more than the air intake quantity fall predetermined value (i.e., when the result of the determination in step S9 is NO), then the quantity of air is regarded as having decreased temporarily and the processing of steps S4 through S8 is performed.

The ignition control of the control unit 7 will now be described using FIG. 1.

The control unit 7 counts the time that has elapsed since the air intake rise point. When it reaches a time that matches the wait time, a command signal (i.e., the Low level signal in FIG. 2) is output to the ignition circuit 9, and the charging of the ignition circuit 9 is started. Furthermore, once the ignition timing is reached, a command signal (i.e., the High level signal in FIG. 2) is once again output to the ignition circuit 9, and the charged energy is supplied to the spark plug 8 and the vapor mixture is ignited.

In this manner, the control unit 7 performs air intake determinations, air intake quantity calculations, fuel injection quantity decisions, and control of the ignition timing using information obtained from the air flow meter 14, without a rotation sensor for the crankshaft 2*d* or a temperature sensor needing to be separately provided. As a result, compared with when a plurality of fault diagnosis programs are provided for each sensor, it is possible to reduce the memory required in the control unit 7 and the load on the processing by the CPU is also light.

The degree of freedom when designing the layout of the overall engine control system 1 is also improved by reducing the number of sensors, and this also contributes to a reduction in the number of assembly steps.

Moreover, even if the timing at which the air intake valve 2*b* of the engine 2 opens and closes is able to be changed in accordance with the number of revolutions of the engine 2, because the fuel injection quantity is decided based on the actual air intake quantity, there is no need for any complex calculation processing in order to decide the injection quantity for various pressures and number of engine revolutions.

Note that the present invention is not limited to the above described embodiment and may be applied over a broad spectrum.

For example, in order to make a distinction with a pulse movement, it is desirable that the air intake quantity fall predetermined value is a larger value than the air intake quantity rise predetermined value, however, they may also be the same value or it is also possible for the air intake quantity fall predetermined value to be a smaller value than the air intake quantity rise predetermined value.

Figure 3:
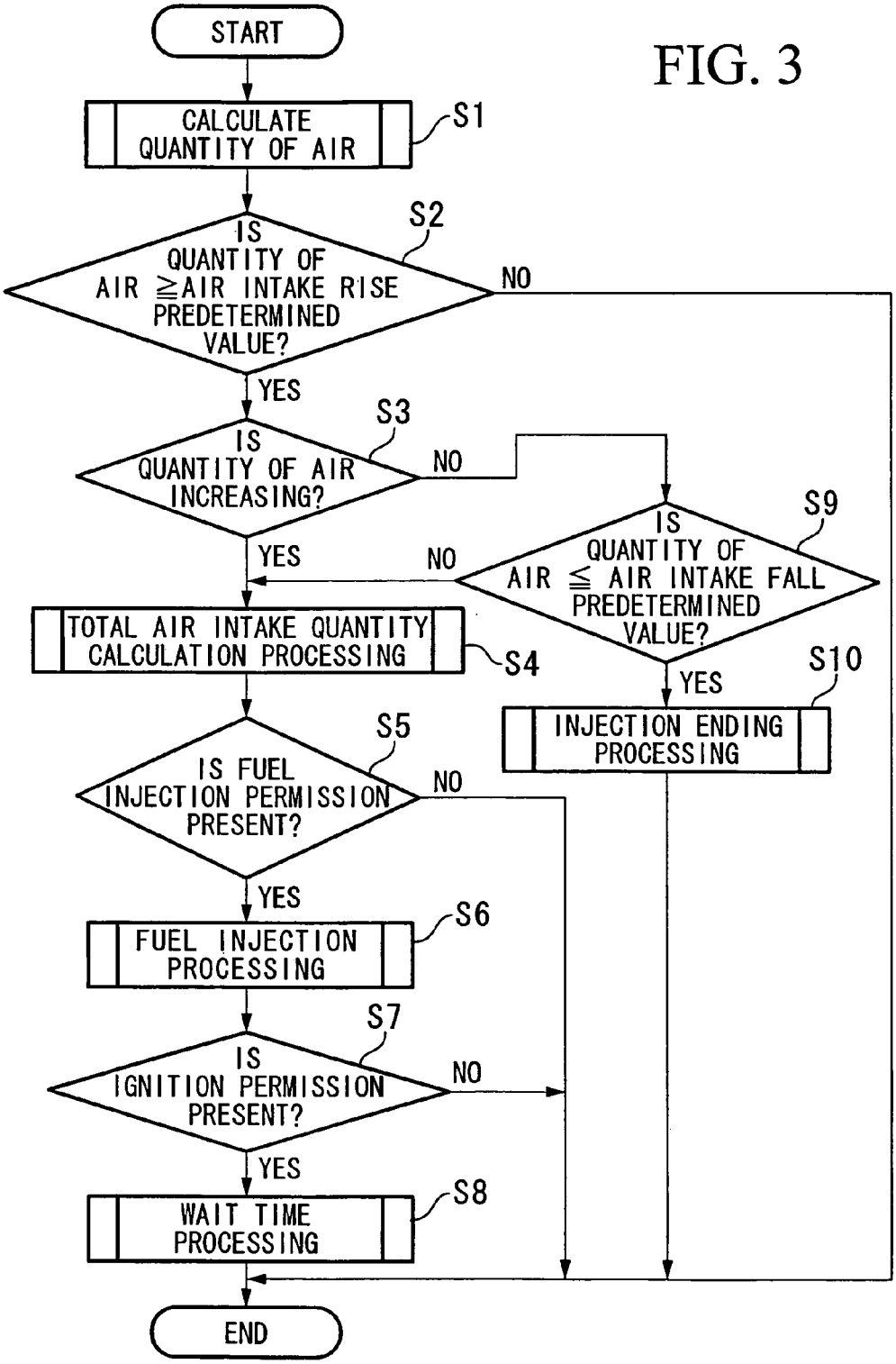
FIG. 3 is a flowchart showing fuel injection control in a control unit.

Moreover, depending on the characteristics of the engine 2 there are cases in which the air intake quantity after the fall point is large and a quantity of fuel obtained by multiplying the air-fuel ratio by the total air intake quantity calculated in step S4 in FIG. 3 is not sufficient. In such cases, the shortfall of fuel is measured in advance and, in the injection ending processing in step S10, the fuel injection may be ended after the quantity of the shortfall has been injected as a surplus amount.

The present invention relates to a control unit for an internal combustion engine that: detects, using a sensor that is located on a downstream side of a throttle valve on an air intake passage of an internal combustion engine, a quantity of air that is taken into the internal combustion engine; and outputs a signal to an injector of the internal combustion engine such that fuel is injected in accordance with this quantity of air, wherein a timing of a rise of an air intake in which the quantity of air increases as an intake stroke of the internal combustion engine progresses and a timing of a fall of an air intake in which the quantity of air decreases as the intake strokes progresses are determined from the quantity of air and the increases and decrease thereof, and a fuel injection quantity is calculated by multiplying a predetermined constant by a quantity of air that is taken in during a period from the timing of the air intake rise until the timing of the air intake fall.

According to the control unit for an internal combustion engine of the present invention, an air intake quantity is detected using a sensor that is located on the engine side of the throttle valve, and the start and end of the air intake can be determined from a rise in the air intake quantity. Accordingly, it is possible to accurately measure an air intake quantity for each intake stroke and to calculate and inject the required fuel.

According to the control unit for an internal combustion engine of the present invention, because the rise of an air intake is determined from the amount of a quantity of air and whether the quantity of air has an increasing or decreasing trend, it is possible to calculate an air intake quantity at the correct timing even in the presence of a pulse flow or minimal flow. Moreover, it is also possible to prevent fuel from being injected irrespective of the fact that air is not actually being taken in.

According to the control unit for an internal combustion engine of the present invention, because the cycles of a rise in an air intake can be counted, and the timings of fuel injections and the timings of ignitions and the like are decided in relation to a rise in the air intake, the number of sensors can be reduced and a reduction in the number of steps when in design and settings can be achieved.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as limited by the foregoing description and is only limited by the scope of the appended claims.

The invention claimed is:

1. A control unit for an internal combustion engine that:

detects, using a sensor that is located on a downstream side of a throttle valve on an air intake passage of an internal combustion engine, a quantity of air that is taken into the internal combustion engine; and outputs a signal to an injector of the internal combustion engine such that fuel is injected in accordance with the quantity of air, wherein a timing of a rise of an air intake in which the quantity of air increases as an intake stroke of the internal combustion engine progresses and a timing of a fall of an air intake in which the quantity of air decreases as the intake strokes progresses are determined from the quantity of air and the increases and decrease thereof, and a fuel injection quantity is calculated by multiplying a predetermined constant by a quantity of air that is taken in during a period from the timing of the air intake rise until the timing of the air intake fall.

2. The control unit for an internal combustion engine according to claim 1, wherein the timings of rises in the air intake are when the quantity of air that increases with elapsed time reaches a predetermined value that is in excess of a quantity that corresponds to a pulse flow or minimal flow of air inside the air intake passage.

3. The control unit for an internal combustion engine according to claim 2, wherein a cycle of the rises in the air intake is measured.

4. The control unit for an internal combustion engine according to claim 1, wherein a cycle of the rises in the air intake is measured.

* * * * *

UNITED STATES PATENT AND TRADEMARK OFFICE

CERTIFICATE OF CORRECTION

PATENT NO. : 7,191,764 B2
APPLICATION NO. : 10/553687
DATED : March 20, 2007
INVENTOR(S) : Shogo Hattori It is certified that error appears in the above-identified patent and that said Letters Patent is hereby corrected as shown below:

On the Title Page of the Patent, Item (30) Foreign Application Priority Data is missing. Item (30):

The Foreign Application Priority Data should read as follows:

April 22, 2003 (JP) .....2003-116813

Signed and Sealed this

Eighteenth Day of September, 2007

JON W. DUDAS
*Director of the United States Patent and Trademark Office*